US008567621B2

(12) United States Patent
Chae

(10) Patent No.: US 8,567,621 B2
(45) Date of Patent: Oct. 29, 2013

(54) CLOSURE AND CONTAINER HAVING THE SAME

(76) Inventor: Dong-Seuk Chae, Gwangmyeong-si (KR)

( * ) Notice: Subject to any disclaimer, the term of this patent is extended or adjusted under 35 U.S.C. 154(b) by 806 days.

(21) Appl. No.: 12/304,022

(22) PCT Filed: Jun. 20, 2007

(86) PCT No.: PCT/KR2007/002986

§ 371 (c)(1),
(2), (4) Date: Jun. 15, 2010

(87) PCT Pub. No.: WO2007/148916

PCT Pub. Date: Dec. 27, 2007

(65) Prior Publication Data

US 2010/0243599 A1 Sep. 30, 2010

(30) Foreign Application Priority Data

Jun. 21, 2006 (KR) ..... 10-2006-0055792

(51) Int. Cl.
*B65D 45/00* (2006.01)

(52) U.S. Cl.
USPC ..... 215/274; 215/334; 215/251; 220/319; 220/315; 220/256.1; 220/254.1

(58) Field of Classification Search
USPC ..... 215/274, 277, 251, 321, 280, 217–221, 215/334; 220/315, 319, 254.1, 256.1
See application file for complete search history.

(56) References Cited

U.S. PATENT DOCUMENTS

| | | | | | |
|---|---|---|---|---|---|
| 1,862,620 | A | * | 6/1932 | Graham | 215/274 |
| 3,693,820 | A | * | 9/1972 | Linkletter | 215/223 |
| 3,893,582 | A | * | 7/1975 | Kowalik | 215/221 |
| 3,923,179 | A | * | 12/1975 | Choksi et al. | 215/203 |
| 3,926,326 | A | * | 12/1975 | Grau | 215/218 |
| 3,952,901 | A | * | 4/1976 | Conti | 215/251 |
| 4,106,654 | A | * | 8/1978 | Jones | 215/329 |
| 4,251,003 | A | * | 2/1981 | Bodenmann | 215/254 |
| 4,330,067 | A | * | 5/1982 | Deussen | 215/220 |
| 5,209,362 | A | * | 5/1993 | Lutzker | 215/225 |
| 5,314,084 | A | * | 5/1994 | Folta et al. | 215/249 |

(Continued)

FOREIGN PATENT DOCUMENTS

| | | |
|---|---|---|
| JP | 8-85566 | 4/1996 |
| JP | 8-324612 | 12/1996 |

(Continued)

*Primary Examiner* — Mickey Yu
*Assistant Examiner* — Brijesh V Patel
(74) *Attorney, Agent, or Firm* — LRK Patent Law Firm

(57) ABSTRACT

The present invention relates to a closure and a container having the same, wherein the closure can be opened or closed through up/down operation to keep contents pressurized. A closure of the present invention comprises a sealing unit for surrounding a mouth of a container to ensure airtightness; a locking unit having a plurality of locking projections hingedly connected to a lower end of the sealing unit so that the locking projections can be caught by a locking flange-of the container; and a cover unit having a vertically movable annular body for surrounding an outer peripheral surface of the locking unit and including a push projection formed to protrude from an inner peripheral surface of the body and to be positioned below the locking unit, and a support projection formed to protrude at a position above the push projection to support the outer peripheral surface of the locking unit.

9 Claims, 5 Drawing Sheets

(56) References Cited

U.S. PATENT DOCUMENTS

| | | | | |
|---|---|---|---|---|
| 5,433,329 | A * | 7/1995 | Weinstein | 215/220 |
| 5,615,788 | A * | 4/1997 | Larguia | 215/274 |
| 5,678,718 | A | 10/1997 | Morris et al. | |
| 5,788,100 | A * | 8/1998 | Sturk | 215/258 |
| 5,813,554 | A * | 9/1998 | Marangoni Graziani et al. | 215/274 |
| 5,957,314 | A * | 9/1999 | Nishida et al. | 215/249 |
| 5,960,972 | A * | 10/1999 | Larguia, Sr. | 215/274 |
| 6,158,604 | A * | 12/2000 | Larguia et al. | 215/217 |
| 7,451,899 | B2 * | 11/2008 | de Pous | 222/321.9 |
| 7,845,505 | B2 * | 12/2010 | Hamamoto et al. | 215/277 |
| 2006/0070970 | A1 * | 4/2006 | Shingle | 215/220 |
| 2009/0014404 | A1 * | 1/2009 | Russell | 215/220 |
| 2009/0120896 | A1 * | 5/2009 | Scarlata | 215/217 |
| 2010/0126997 | A1 * | 5/2010 | Stull et al. | 220/281 |

FOREIGN PATENT DOCUMENTS

| | | |
|---|---|---|
| KR | 1998-027686 | 8/1998 |
| KR | 2000-0016647 | 9/2000 |
| WO | WO 0238461 A1 * | 5/2002 |

* cited by examiner

CLOSURE AND CONTAINER HAVING THE SAME

TECHNICAL FIELD

The present invention relates to a closure and a container having the same, and more particularly, to a closure and a container having the same, wherein the closure can be opened or closed through an up/down operation to hermetically keep contents at a pressure equal to, above or below the atmospheric pressure.

BACKGROUND ART

A container for storing beverages, powder or other contents is generally provided with a closure that requires to have a variety of functions depending on uses of the storing container or the stored contents.

For example, since the internal pressure of a carbonated beverage container should be maintained at a pressure equal to or greater than the atmospheric pressure, it is important to maintain the airtightness of the closure during distribution of the container.

In case of a container with large capacity, it is preferred that a closure be configured to be hermetically re-closed conveniently after opening the closure so that after the contents of the container are used, the remainder of the contents can be stored without being deteriorated. For example, a cork closure has excellent airtightness but has a problem in that it is not easy to open the cork closure.

Further, in case of a screw top that has been widely used in a conventional beverage container, it is inconvenient to use the screw top since the screw top should be rotated. Specifically, since children are too inexperienced in rotating the screw top to be opened/closed, it is very inconvenient for children to use the screw top.

Particularly, the screw top should be strongly fastened in order to prevent contents from leaking out. In this case, however, it is difficult to re-open the screw top. On the contrary, if the screw top is closed only to the extent that the screw top can be easily operated, the contents of the container may leak out.

In order to solve the above problems, the inventor proposed conveniently usable closure structures in Korean Patent No. 10-575259 (issued on Apr. 24, 2006) and Korean Utility Model Registration No. 20-385497 (issued on May 21, 2005). Since these closures are opened or closed in a one-touch manner, there is an advantage in that they can be more conveniently used as compared with a screw top.

DISCLOSURE OF INVENTION

Technical Problem

The present invention is to improve the structures of conventional closures. Accordingly, an object of the present invention is to provide a closure which has air-tightness capable of sufficiently sealing contents even though the contents are stored in a container while being under a predetermined pressure, can be conveniently used, and is configured such that after initial opening of the closure, other users can easily recognize the opening of the closure, and a container having the closure.

Technical Solution

According to an aspect of the present invention for achieving the object, there is provided a closure comprising: a sealing unit for surrounding a mouth of a container to ensure airtightness; a locking unit having a plurality of locking projections hingedly connected inward to and along a lower end of the sealing unit so that the locking projections can be fixedly caught by a locking flange of the container; and a cover unit having a vertically movable annular body for surrounding an outer peripheral surface of the locking unit and including a push projection formed to protrude from an inner peripheral surface of the body and to be positioned below the locking unit, and a support projection formed to protrude at a position above the push projection to support the outer peripheral surface of the locking unit.

According to another aspect of the present invention, there is provided a closure comprising: a sealing unit for surrounding a mouth of a container to ensure air-tightness; a locking unit having a plurality of locking projections hingedly connected inward to and along a lower end of the sealing unit so that the locking projections can be fixedly caught by a locking flange of the container, and a plurality of lever projections formed to protrude on an outer peripheral surface of the locking unit that is opposite to the locking projections; and a cover unit having a vertically movable annular body for surrounding the outer peripheral surface of the locking unit and including a push projection formed to protrude from an inner peripheral surface of the body and to be positioned below the lever projections.

According to a further aspect of the present invention, there is provided a container comprising: a container body having a locking flange protruding from an outer peripheral surface of a mouth of the container; and a closure fitted around the mouth while surrounding the mouth to ensure airtightness, wherein the closure comprises a sealing unit for surrounding the mouth of the container to ensure airtightness; a locking unit having a plurality of locking projections hingedly connected inward to and along a lower end of the sealing unit so that the locking projections can be fixedly caught by a locking flange of the container; and a cover unit having a vertically movable annular body for surrounding an outer peripheral surface of the locking unit and including a push projection formed to protrude from an inner peripheral surface of the body and to be positioned below the locking unit, and a support projection formed to protrude at a position above the push projection to support the outer peripheral surface of the locking unit.

According to a still further aspect of the present invention, there is provided a container comprising: a container body having a locking flange protruding from an outer peripheral surface of a mouth of the container; and a closure fitted around the mouth while surrounding the mouth to ensure airtightness, wherein the closure comprises a sealing unit for surrounding the mouth of the container to ensure air-tightness; a locking unit having a plurality of locking projections hingedly connected inward to and along a lower end of the sealing unit so that the locking projections can be fixedly caught by a locking flange of the container, and a plurality of lever projections formed to protrude on an outer peripheral surface of the locking unit that is opposite to the locking projections; and a cover unit having a vertically movable annular body for surrounding the outer peripheral surface of the locking unit and including a push projection formed to protrude from an inner peripheral surface of the body and to be positioned below the lever projections.

Advantageous Effects

According to the present invention, the closure has excellent airtightness and can also be conveniently used. Further, after the initial opening of the closure of a container, it is possible to recognize the opening of the closure.

BEST MODE FOR CARRYING OUT THE INVENTION

Hereinafter, embodiments of the present invention will be described in detail with reference to the accompanying drawings.

Figure 1:
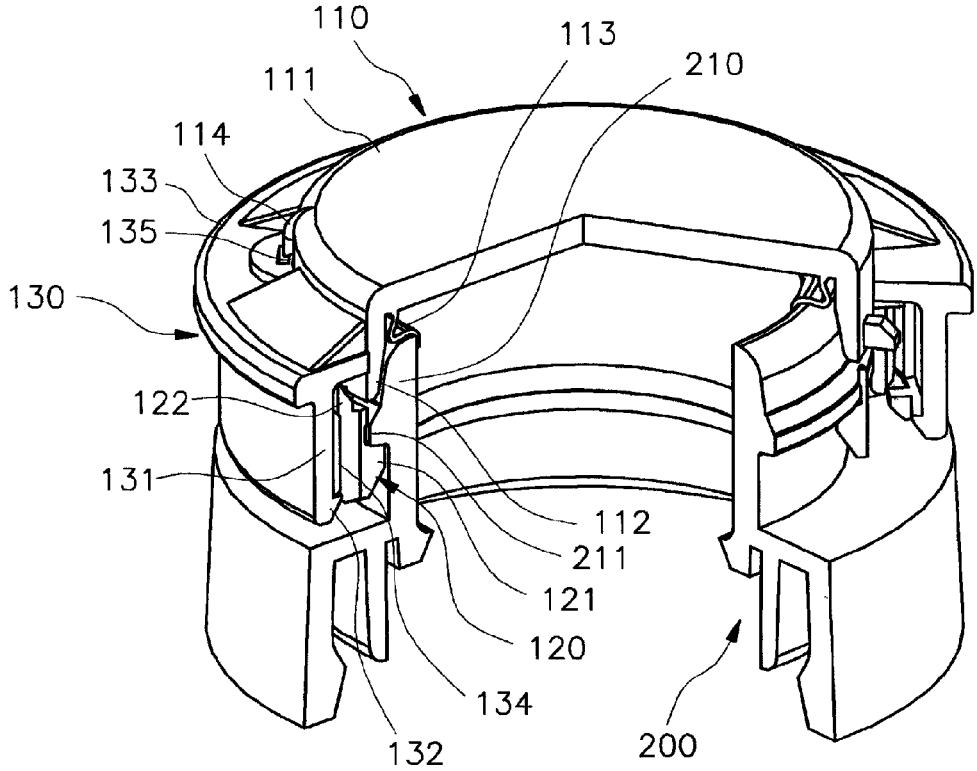
FIG. 1 is a partially cut-away perspective view showing a closure according to a preferred embodiment of the present invention.
Figure 2:
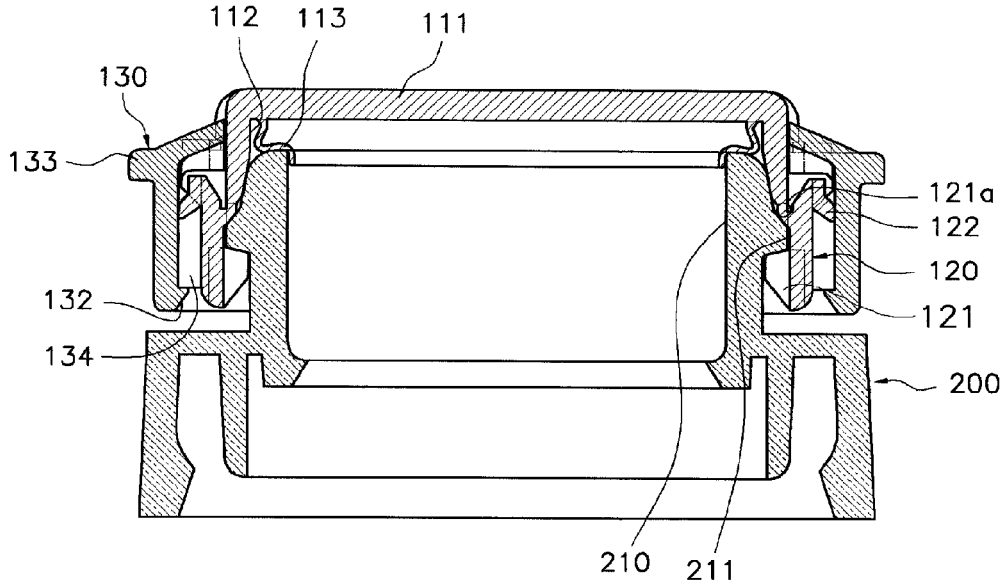
FIG. 2 is a sectional view showing the closure according to the present invention.

Referring to FIGS. 1 and 2, a container has a container body 200 provided with a mouth 210 at an upper portion thereof. An annular locking flange 211 is formed to protrude from an outer peripheral surface of the mouth 210. A lower surface of the locking flange 211 is perpendicular to the outer peripheral surface of the mouth 210 while an upper surface of the locking flange 211 has a smoothly-curved surface.

A closure includes a sealing unit 110, a locking unit 120, and a cover unit 130.

The sealing unit 110 includes a circular top portion 111 and a skirt 112 to be inserted into the mouth 210 of the container.

A sealing rib 113 that comes into close contact with the mouth 210 may be formed to protrude from a lower surface of the top portion 111 of the sealing unit 110. When the closure is closed, the sealing rib 113 is brought into close contact with the mouth 210 of the container and then elastically deformed to increase airtightness of the closure.

A lower end of the sealing unit 110 is provided with the locking unit 120 for fixing the closure to the container.

Specifically, the locking unit 120 includes locking projections 121, which are fixedly caught by the locking flange 211 of the container, and lever projections 122 for releasing the fixed state of the locking projections 121.

The locking projections 121 are hingedly connected inward to and along the lower end of the sealing unit 110. Accordingly, when the closure is inserted into the mouth of the container, the locking projections 121 are caught by the locking flange 211 of the container so that the closure can be fixed thereto.

A plurality of lever projections 122 are formed on an outer peripheral surface of the locking unit 120 which is opposite to the locking projections 121.

That is, the locking unit 120 is provided with the locking projections 121 at the inside thereof and the lever projections 122 at the outside thereof. Accordingly, when the lever projections 122 formed at the outside of the locking unit 120 are pressed, the locking projections 121 formed at the inside of the locking unit 120 are moved outward with respect to hinge portion 121*a*, so that the locking projections 121 are released from the locking flange 211, thereby opening the closure.

The operation of the lever projections 122 is substantially achieved by manipulating the cover unit 130 that will be described later.

Meanwhile, the sealing unit 110 and the locking unit 120 may be formed integrally with each other out of a resin by means of injection molding. However, the sealing unit 110 and the locking unit 120 may be separately manufactured and then assembled.

The cover unit 130 has an annular body 131 and includes a push projection 132 formed to protrude from an inner peripheral surface of the body 131 and to be positioned below the lever projections 122.

The cover unit 130 is positioned onto the outer peripheral surface of locking unit 120 so that the cover unit 130 can be moved upward and downward. Meanwhile, when the cover unit 130 is moved upward with respect to the locking unit 120, the push projection 132 of the cover unit 130 pushes the lever projections 122 upward. Accordingly, the lever projections 122 are pivoted so that the locking projections 121 formed inside of the locking unit 120 are released from the locking flange 211, thereby opening the closure.

Figure 3:
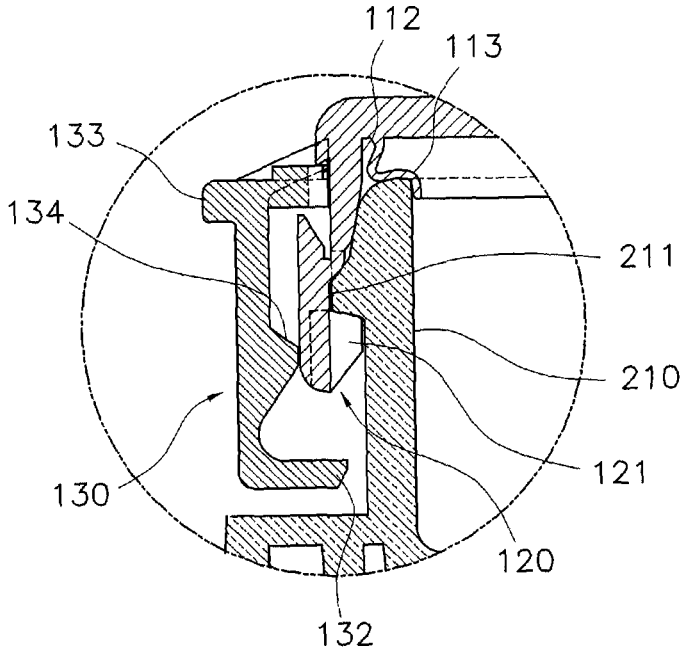
FIG. 3 is a view showing a variant of a sealing unit of the closure according to the present invention.

Meanwhile, FIG. 3 is a view showing a variant of the sealing unit of the closure according to the present invention. Although there is no additional lever projection on an outer peripheral surface of the sealing unit 110, the cover unit 130 may cause the sealing unit 110 to be operated in the same manner.

That is, since the push projection 132 is formed at a lower end of the cover unit 130 so as to be positioned below a lower end of the locking unit 120, the push projection 132 pushes the lower end of the locking unit 120 upward when the cover unit 130 is moved upward, so that the locking projections 121 of the locking unit 120 are released from the locking flange 211 to open the closure, although there is no additional lever projection on the outer peripheral surface of the sealing unit 110.

Reference numeral 134 designates a support projection formed above an upper end of the push projection 132 so as to protrude from the inner peripheral surface of the cover unit 130 and to support the outer peripheral surface of the locking unit 120. The support projection 134 prevents the locking projections 121 from being moved outward due to the internal pressure of the container when the closure is closed. Meanwhile, since the support projection 134 is moved upward when the closure is opened, the support projection 134 does not interfere with the outward movement of the locking projections 121.

Although the embodiment shown in FIG. 3 is substantially identical with that shown in FIGS. 1 and 2 in view of their operations, they are different from each other only in that the push projection of the cover unit pushes the lower end of the locking unit directly or pushes the locking projections of the locking unit to open the closure depending on whether there are the lever projections formed on the outer peripheral surface of the sealing unit.

Referring back to FIGS. 1 and 2, it is preferred that a holding protrusion 133 be formed to protrude outward from an outer peripheral surface of the cover unit 130 in the present invention, thereby allowing the closure to be conveniently used upon opening of the closure.

For example, when the thumb is used to press down the upper portion of the sealing unit 110 and the remaining fingers except the thumb are used to grasp the annularly protruding holding protrusion 133 of cover unit 130, the closure is opened according to the operations described above. Accordingly, the closure can be easily opened with one hand.

Meanwhile, if a user excessively presses down the sealing unit 110 in the process of opening the closure by pressing down the sealing unit 110 with the cover unit 130 grasped by the user, the cover unit 130 may be separated from the sealing unit 110. In order to prevent this accidental separation, it is preferred that the closure be further provided with a means for limiting a maximum operation range between the sealing unit 110 and the cover unit 130 upon opening of the closure.

Figure 4:
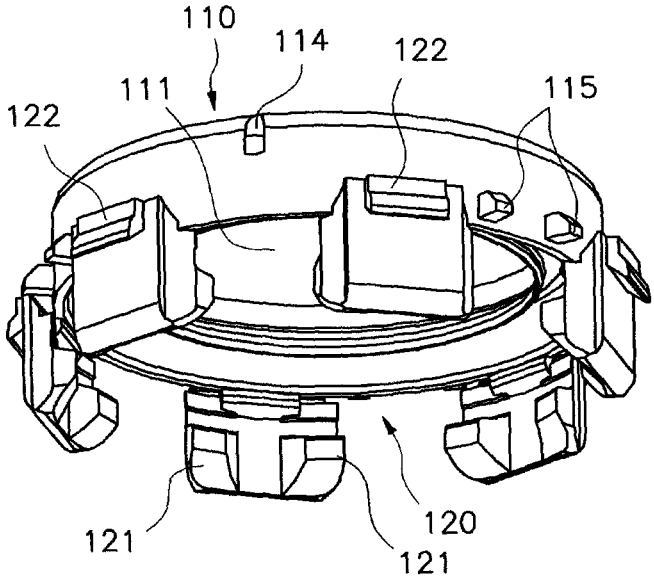
FIG. 4 is a view showing only both a sealing unit and a locking unit of the closure according to the present invention.
Figure 5:
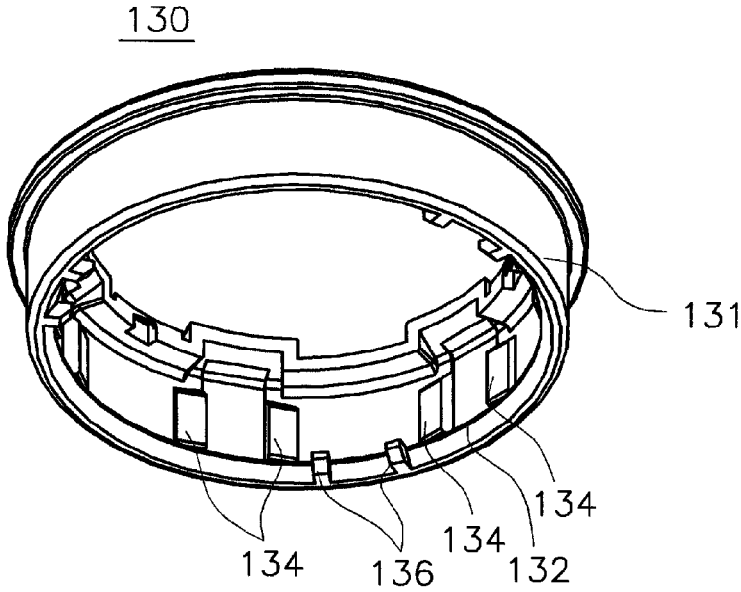
FIG. 5 is a view showing only a cover unit of the closure according to the present invention.

For example, referring to FIGS. 4 and 5, first stoppers 115 are formed to protrude from an outer peripheral surface of the skirt 112 of the sealing unit 110 while second stoppers 136 are formed to protrude from the inner peripheral surface of the cover unit 130.

Accordingly, the first stoppers 115 of the sealing unit 110 and the second stoppers 136 of the cover unit 130 are engaged with each other before a deviation from the maximum operation range occurs when the user excessively presses down the sealing unit 110 in the process of opening the closure, thereby preventing the separation of the cover unit 130 from the sealing unit 110.

As another example, the sealing unit and the cover unit may be provided with a stopper projection and a groove, respectively, so that the cover unit cannot be separated from the sealing unit during the operation thereof.

That is, the cover unit is provided with the groove while the sealing unit is provided with the stopper projection which is to be inserted into the groove. When the sealing unit is operated, the stopper projection is moved along the groove. The maximum operation range of the sealing unit upon opening of the closure may be determined according to the length of the groove along which the stopper projection is guided.

Preferably, the present invention is characterized in that the support projection 134 is formed to protrude from the inner peripheral surface of the body 131 of the cover unit 130 at a position above the push projection 132 so as to support the outer peripheral surface of the locking unit 120.

The support projection 134 prevents the locking projections 121 of the locking unit 120 from being moved outward in a state where the locking projections 121 have been caught by the locking flange 211 of the container. Accordingly, the contents of the container are prevented from leaking out in a state where the closure is closed, thereby improving the airtightness of the closure.

Next, the present invention is characterized in that the cover unit is further provided with a band portion which is formed to be broken if a relative positional change exceeding a predetermined range occurs between the sealing unit and the cover unit. The band portion of the sealing unit is broken when the closure is initially opened, so that a user can recognize that the closure has been opened by checking the breakage of the band portion.

The band portion in the present invention may be provided by a variety of means. That is, when the closure of the present invention is opened, the relative positional change occurs between the cover unit and the sealing unit (or the locking unit). Accordingly, it is possible to provide the band portion which is to be broken by the positional change occurring between the cover unit and the sealing unit (or locking unit) upon opening of the closure.

Specifically, referring to FIG. 1, a tip 114 that is directed downward is formed at an edge of the sealing unit 110, while a band 135 having an appropriate thickness is formed at a position on the cover unit 130 corresponding to the tip 114. The band 135 is broken by the tip 114 when the closure is initially used. Accordingly, the user can recognize whether the container has already been opened and used by checking whether the band is broken.

Figure 6:
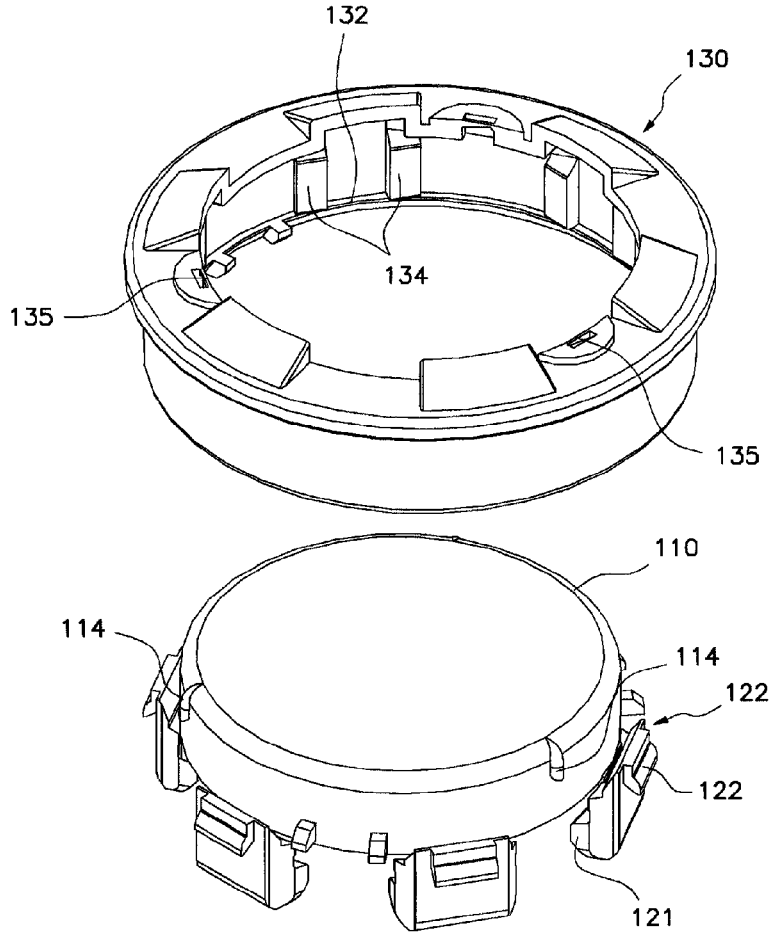
FIG. 6 is an exploded perspective view showing the closure according to the present invention.

FIG. 6 is an exploded perspective view showing the closure according to the present invention, which also illustrates an assembly process of the closure of which components are substantially separately manufactured.

The sealing unit 110 and the locking unit 120 may be integrally formed by means of injection molding as describe above or may be separately manufactured and then assembled. Meanwhile, in this embodiment, the sealing unit 110 and the locking unit 120 will be described as being integrally formed by means of injection molding.

First, the sealing unit 110 and the locking unit 120 are injection-molded in a single-piece. The cover unit 130 is also injection-molded through another additional process and then assembled with the locking unit by fitting the cover unit 130 around the locking unit 120.

To do this, the cover unit 130 and the locking unit 120 are located at upper and lower positions, respectively, as shown in FIG. 6 and then assembled by fitting the cover unit 130 around the locking unit 120. At this time, since the tip 114 protrudes downward, the tip 114 is inserted while a smooth curved portion of the tip pushes the band 135, so that the band 135 is not broken in the assembly process.

However, since the sealing unit 110 is pressed down with the cover unit 130 grasped by a user when the closure is used, such a process causes the tip 114 to be inserted into a hole of the band 135, so that the band 135 is broken and the sealing unit 110 is moved downward.

That is, when the closure is initially opened, the band 135 is broken while the sealing unit 110 is moved downward. Thus, the user can confirm whether a container has been already opened, by checking whether the band is broken.

Figure 7:
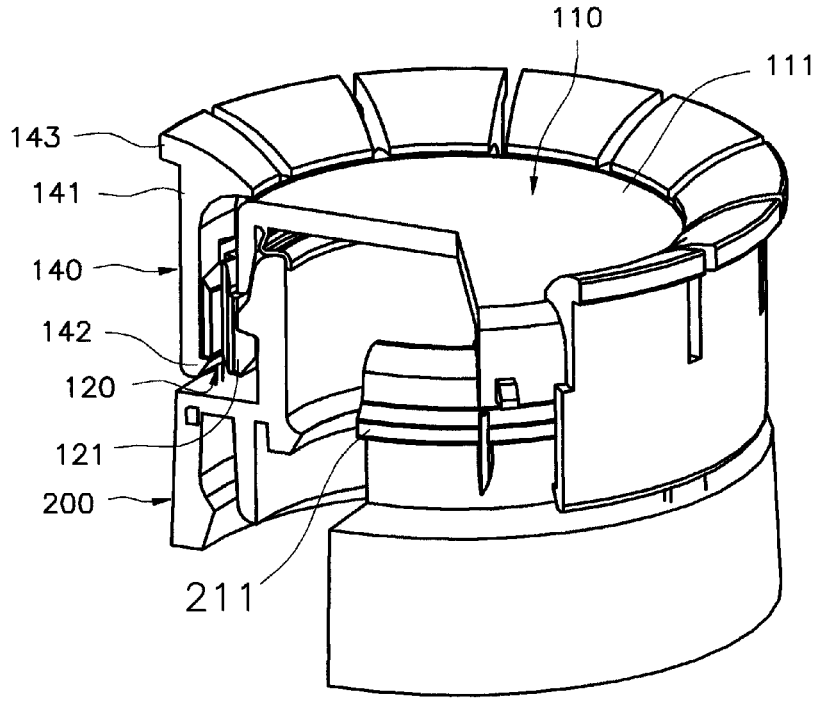
FIGS. 7 and 8 are views showing a closure according to another embodiment of the present invention.
Figure 8:
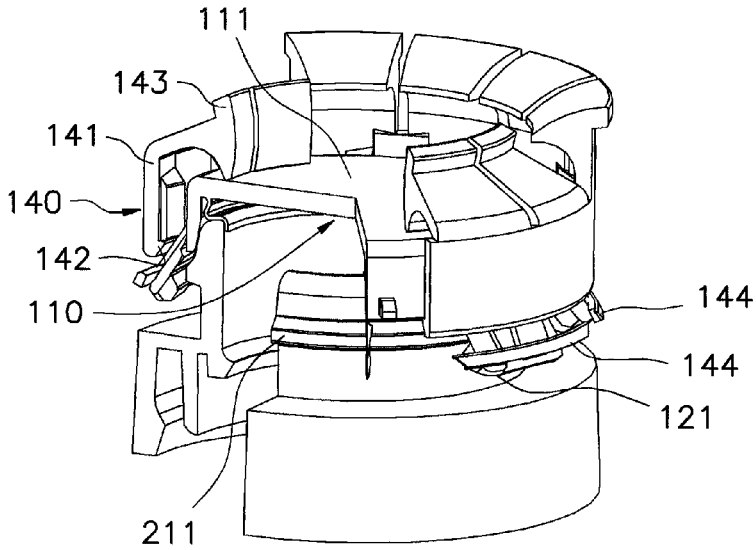

Next, FIGS. 7 and 8 are views showing a closure according to another embodiment of the present invention. FIG. 7 shows a closed state of the closure, and FIG. 8 shows an opened state of the closure.

Referring to FIGS. 7 and 8, the closure according to the other embodiment of the present invention is characterized in that an upper portion of a cover unit 140 is radially cut out and an inner leading end thereof is directed to an upper surface of a sealing unit.

Since the sealing unit and a locking unit in this embodiment are identical with those in the previous embodiment described above, the difference between their cover units will be mainly described below. Like reference numerals will be used to designate the sealing unit and the locking unit.

The cover unit 140 includes an annular body 141 that surrounds the outer peripheral surface of the locking unit 120 and can be moved upward and downward, and a push projection 142 that is formed at a lower end of the body 141 so as to push the lower end of the locking unit 120 or the lever projections of the locking unit 120, which are identical with those in the previous embodiment.

Meanwhile, the upper portion of the cover unit 140 is designed to be at a higher level than the top portion 111 of the sealing unit 110 and to have an upper edge that is radially cut out. Further, the inner leading end of the upper portion of the cover unit 140 is inclined to be directed to the top portion 111 of the sealing unit.

Further, the upper portion of the cover unit 140 may be provided with a holding protrusion portion 143 protruding outward.

When a user presses the cover unit 140 in a laterally inward direction to open the closure, the inner leading end of the upper portion of the cover unit 140 is rotated inward to press down the top portion 111 of the sealing unit 110, so that the cover unit 140 is moved upward. Accordingly, as the cover unit 140 is moved upward, the push projection 142 provided at the lower end of the cover unit 140 pushes the locking unit 120 upward to open the closure, as shown in FIG. 8.

Meanwhile, FIG. 8 also shows another embodiment of the band portion that can be used to recognize whether the initial opening of the closure has been made, wherein the locking projections 121 are moved outward in order to open the closure and a circular band 144 with a certain thickness formed at the lower end of the cover unit 140 is then broken. Accordingly, the user can recognize whether the closure has already been opened, by checking whether the circular band 144 formed at the lower end of the cover unit 140 is broken.

Next, a container according to the present invention is characterized in that an inner peripheral surface of a mouth of a container body has a cylindrical shape, an upper end of the inner peripheral surface is provided with an inclined surface connected thereto via an inflection edge to achieve an increase in the inner diameter of the mouth, and a lower surface of a sealing unit of a closure for the container is further provided with a sealing rib that is formed to protrude in an annular shape and to extend to below the inflection edge of the inner peripheral surface of the mouth of the container body so as to be brought into close contact with and fixed to the inner peripheral surface.

Accordingly, as described above, the sealing rib is provided to improve airtightness of the closure, wherein if the internal pressure of the container becomes equal to or greater than a predetermined pressure, the sealing rib allows a gas in the container to be naturally exhausted, if necessary, so that the pressure in the container can be prevented from being raised above the predetermined pressure.

Figure 9:
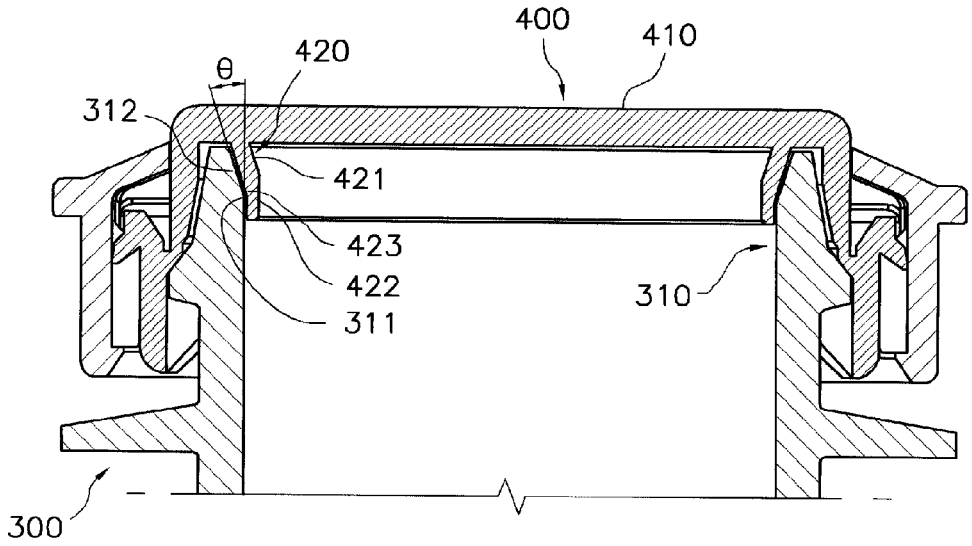
FIGS. 9 and 10 are views showing a closure according to a further embodiment of the present invention.
Figure 10:
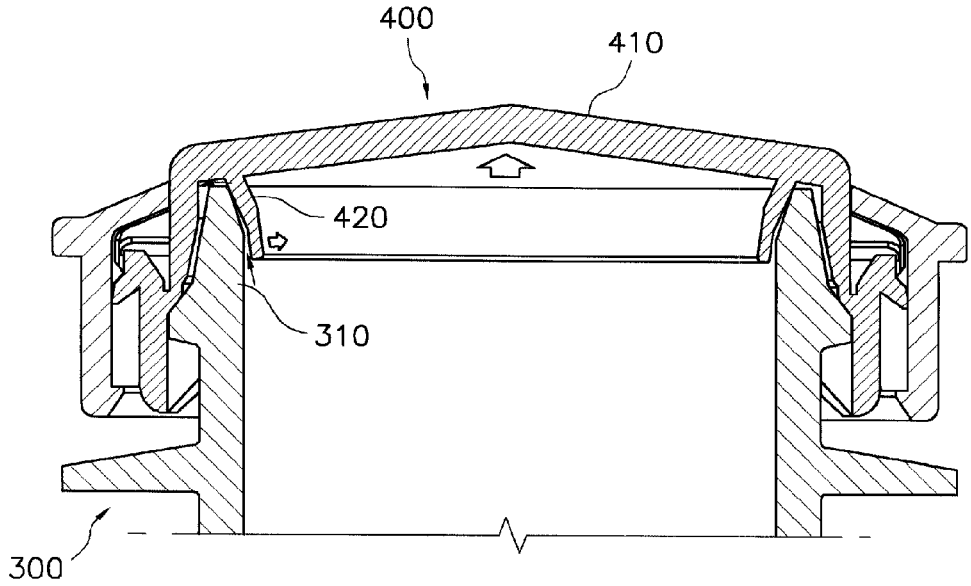

Specifically, referring to FIGS. 9 and 10, FIG. 9 shows a state before pressure is exerted in the container and FIG. 10 shows another state where excessive pressure is exerted in the container.

Referring to FIG. 9, an inner peripheral surface of a mouth 310 of a container body 300 has a generally cylindrical shape, and an upper end of the inner peripheral surface is provided with an inclined surface 312 at a predetermined angle θ, which is connected thereto via an inflection edge to achieve an increase in the inner diameter of the mouth.

The inclined surface formed in the inner peripheral surface of the mouth 310 of the container body 300 may be a curved surface.

Meanwhile, an annular sealing rib 420 is formed to protrude from a lower surface of a sealing unit 410 of a closure 400.

Specifically, the sealing rib 420 has a shape which corresponds to that of the inner peripheral surface of the mouth 310 of the container body 300. That is, the sealing rib 420 includes a first rib member 421 having an inclination identical with that of the inclined surface 312 formed at the mouth 310 of the container body 300, and a second rib member 422 having an outer diameter identical with that of the mouth 310 of the container body 300.

When the closure 400 having the sealing rib 420 is fitted around and fixed to the container body 300, the sealing rib 420 is press-fitted around the mouth 310 of the container body 300 to achieve airtightness.

Then, referring to FIG. 10, if an internal pressure equal to or greater than a predetermined pressure is produced in the container, the sealing unit 410 of the closure is elastically deformed to be upward convex due to the internal pressure, and the sealing rib 420 formed at the lower portion of the sealing unit 410 is moved upward and simultaneously spaced apart from a wall surface of the mouth 310 of the container, resulting in a gap created between the sealing rib 420 and the wall surface of the mouth 310 so that a gas in the container can be exhausted to the outside through the gap.

If the internal pressure in the container is decreased after the gas in the container is exhausted to the outside, the sealing unit 410 of the closure is returned to its original state and the sealing rib 420 is simultaneously moved downward and then brought into close contact with the wall surface of the mouth 310 to achieve airtightness.

The invention claimed is:

1. A closure comprising:

a sealing unit for surrounding a mouth of a container to ensure airtightness;

a locking unit having a plurality of locking projections hingedly connected inward to and along a lower end of the sealing unit so that the locking projections can be fixedly caught by a locking flange of the container; and a cover unit having a vertically movable annular body for surrounding an outer peripheral surface of the locking unit, the cover unit including a push projection formed to protrude from an inner peripheral surface of the body and to be positioned below the locking unit, and a support projection formed to protrude at a position above the push projection to support the outer peripheral surface of the locking unit, wherein the locking projections are actuated by axial movement of the cover unit, sealing and unsealing the closure to the container, and wherein the push projection is formed to push a lower end of the locking unit upward when the cover unit is moved upward with respect to the locking unit, so that the locking projections of the locking unit can he released from the locking flange to open the closure.

2. A closure comprising:

a sealing unit for surrounding a mouth of a container to ensure airtightness;

a locking unit having a plurality of locking projections hingedly connected inward to and along a lower end of the sealing unit so that the locking projections can be fixedly caught by a locking flange of the container, and a plurality of lever projections formed to protrude on an outer peripheral surface of the locking unit that is opposite to the locking projections; and a cover unit having a vertically movable annular body for surrounding the outer peripheral surface of the locking unit, the cover unit including a push projection formed to protrude from an inner peripheral surface of the body and to be positioned below the lever projections, wherein the locking projections are actuated by axial movement of the cover unit, sealing and unsealing the closure to the container, and wherein the push projection of the cover unit is formed to push the lever projections upward such that the lever projections are pivoted when the cover unit is moved upward with respect to the locking unit, so that the locking projections of the locking unit can be released from the locking flange to open the closure.

3. The closure as claimed in claim 2, wherein the cover unit is further provided with a support projection formed to protrude from the inner peripheral surface of the body of the cover unit above the push projection so as to support the outer peripheral surface of the locking unit.

4. The closure as claimed in claim 1, wherein the cover unit is further provided with a holding protrusion protruding outward from an outer peripheral surface of the cover unit.

5. The closure as claimed in claim 1, wherein the cover unit is further provided with a band portion formed to be broken if a relative positional change exceeding a predetermined range occurs between the sealing unit and the cover unit.

6. The closure as claimed in claim 1, wherein an upper portion of the cover unit is radially cut out, and an inner leading end thereof is directed to an upper surface of the sealing unit.

7. A container comprising:

a container body having a locking flange protruding from an outer peripheral surface of a mouth of the container; and a closure fitted around the mouth while surrounding the mouth to ensure airtightness, wherein the closure comprises:

a sealing unit for surrounding the mouth of the container to ensure airtightness;

a locking unit having a plurality of locking projections hingedly connected inward to and along a lower end of the sealing unit so that the locking projections can be fixedly caught by a locking flange of the container; and a cover unit having a vertically movable annular body for surrounding an outer peripheral surface of the locking unit, the cover unit including a push projection formed to protrude from an inner peripheral surface of the body and to be positioned below the locking unit, and a support projection formed to protrude at a position above the push projection to support the outer peripheral surface of the locking unit, wherein the locking projections are actuated by axial movement of the cover unit, sealing and unsealing the closure to the container, and wherein the push projection is formed to push a lower end of the locking unit upward when the cover unit is moved upward with respect to the locking unit, so that the locking projections of the locking unit can be released from the locking flange to open the closure.

8. A container comprising:

a container body having a locking flange protruding from an outer peripheral surface of a mouth of the container; and a closure fitted around the mouth while surrounding the mouth to ensure airtightness, wherein the closure comprises:

a sealing unit for surrounding the mouth of the container to ensure airtightness;

a locking unit having a plurality of locking projections hingedly connected inward to and along a lower end of the sealing unit so that the locking projections can be fixedly caught by a locking flange of the container, and a plurality of lever projections formed to protrude on an outer peripheral surface of the locking unit that is opposite to the locking projections; and a cover unit having a vertically movable annular body for surrounding the outer peripheral surface of the locking unit, the cover unit including a push projection formed to protrude from an inner peripheral surface of the body and to be positioned below the lever projections, wherein the locking projections are actuated by axial movement of the cover unit, sealing and unsealing the closure to the container, and wherein the push projection of the cover unit is formed to push the lever projections upward such that the lever projections are pivoted when the cover unit is moved upward with respect to the locking unit, so that the locking projections of the locking unit can be released from the locking flange to open the closure.

9. The container as claimed in claim 7, wherein an inner peripheral surface of the mouth of the container body has a cylindrical shape, an upper end of the inner peripheral surface is provided with an inclined surface connected thereto via an inflection edge to achieve an increase in the inner diameter of the mouth, and a lower surface of the sealing unit of the closure is further provided with a sealing rib that is formed to protrude in an annular shape and to extend to below the inflection edge of the inner peripheral surface of the mouth of the container body so as to be brought into close contact with and fixed to the inner peripheral surface.

* * * * *